US005855543A

United States Patent [19]

Carbone

[11] Patent Number: 5,855,543

[45] Date of Patent: Jan. 5, 1999

[54] BOX MAKING DEVICE AND METHOD FOR USING

[76] Inventor: Martin R. Carbone, 1227 De La Vina St., Santa Barbara, Calif. 93101

[21] Appl. No.: 880,759

[22] Filed: Jun. 23, 1997

Related U.S. Application Data

[62] Division of Ser. No. 775,669, Dec. 31, 1996, Pat. No. 5,707,327.

[51] Int. Cl.[6] ..... B31B 47/00; B31B 1/62

[52] U.S. Cl. ..... 493/59; 493/70; 493/80; 493/396; 493/901

[58] Field of Search ..... 493/57, 58, 59, 493/60, 61, 69, 70, 71, 72, 79, 80, 81, 128, 160, 162, 395, 396, 397, 398, 399, 405, 406, 458, 473, 953

[56] References Cited

U.S. PATENT DOCUMENTS

| | | | |
|---|---|---|---|
| 1,153,951 | 9/1915 | Plante . | |
| 1,221,213 | 4/1917 | Plante . | |
| 1,705,748 | 3/1929 | Bridgman . | |
| 1,847,515 | 3/1932 | Holmer . | |
| 2,056,092 | 9/1936 | Claff . | |
| 2,056,093 | 9/1936 | Claff . | |
| 2,114,948 | 4/1938 | Wehner . | |
| 3,596,823 | 8/1971 | Zitzelman . | |
| 3,786,732 | 1/1974 | Forbes . | |
| 3,884,132 | 5/1975 | Snodgrass . | |
| 4,100,844 | 7/1978 | Spengler . | |
| 4,129,065 | 12/1978 | Corse . | |
| 4,280,810 | 7/1981 | Strible | 493/356 |
| 4,373,929 | 2/1983 | Smith | 493/355 |
| 4,410,089 | 10/1983 | Bortolani | 493/79 |
| 4,642,086 | 2/1987 | Howarth | 493/341 |
| 4,816,015 | 3/1989 | Holder | 493/355 |
| 4,822,325 | 4/1989 | Vossen | 493/59 |
| 5,064,409 | 11/1991 | Campbell | 493/396 |
| 5,073,162 | 12/1991 | Campbell | 493/396 |
| 5,156,584 | 10/1992 | Cohen | 493/472 |

FOREIGN PATENT DOCUMENTS

| | | | |
|---|---|---|---|
| 345351 | 10/1913 | France | 493/160 |

*Primary Examiner*—John Sipos
*Assistant Examiner*—Christopher W. Day
*Attorney, Agent, or Firm*—Wagner, Middlebrook & Kimbell, LLP

[57] ABSTRACT

A kit for making boxes from paper card stock. The kit has a flat plate with a guide rail with a vertical edge projecting above the surface of the plate parallel to one edge of the plate. A scoring groove traverses the plate parallel to the vertical edge of the guide rail. One or more spacing strips, each having a vertical edge, may be placed between the vertical edge of the guide rail and the scoring groove to vary the depth of the box. The overall size or "footprint" of a box made in accordance with the invention is determined by the distance of the scoring groove from the nearest vertical edge and the size of the blank card stock employed. Two identical sized card stocks are used for each box. A slightly wider spacing strip is used to form the top than the spacing strip used to form the bottom of the box. This also makes the depth of the box bottom slightly greater than the box top. The kit includes a scoring plate, two sets of spacing strips and a scoring tool, and is used to fashion boxes in a variety of shapes and sizes. In another embodiment of the kit the scoring plate has guide rails and score lines on both sides, wherein the guide rail on one side is spaced slightly further away from the score line than on the other side to make the box bottom slightly smaller in size than the box top.

4 Claims, 5 Drawing Sheets

BOX MAKING DEVICE AND METHOD FOR USING

This application is a division of application Ser. No. 08/775,669 filed Dec. 31, 1996 which application is now U.S. Pat. No. 5,707,327.

BACKGROUND OF THE INVENTION

1. Field of the Invention

This invention relates to a kit for making boxes and, more particularly to a kit for making boxes in a variety of shapes and sizes.

2. Prior Art

Boxes or cartons are traditionally made from a semi-rigid cardboard stock by first cutting a cardboard blank to the desired dimensions of the outer walls and flaps. The cardboard blanks are then scored on fold lines and the scored fold lines are notched between the various flaps so that the top or bottom of the box or container may be folded. Such box making equipment usually employs a scoring and slotting machine which is adaptable for producing boxes in a variety of sizes. Such a machine is expensive and not normally available for individual use. It is, therefore, desirable to produce a versatile system for making boxes whereby one or more custom boxes may be inexpensively made by any individual at his/her home or place of work. The inventor's prior box making kit and method of U.S. Pat. No. 5,484,373 is unique in that it allows a user to make boxes out of card stock into a great number of sizes and depths. However, this kit preferentially required use of two different sizes of card stock to make the top and bottom of the box, with the card stock for the box top preferentially being slightly longer and wider than the card stock for the box bottom. There accordingly remains a need for a kit for making boxes which is ideally adapted for use with single sizes of card stock for use in making the box top and box bottom.

SUMMARY OF THE INVENTION

The present invention provides an inexpensive kit comprising the tools necessary for manufacturing boxes or containers from a card stock on a small scale. The kit of the present invention preferably has a means for making boxes in a variety of sizes, volumes and shapes. It is therefore, an object of this invention to provide a kit for making boxes from a card stock which includes components which can be readily used with no additional tools or power.

It is another object of this invention to provide a kit for manufacturing boxes which enables the production of boxes in a variety of depths.

It is still another object of this invention to provide identical card stock blanks for tops and bottoms of boxes, which, when identically scored and folded using the kit of the present invention, matingly fit together, one over the other, in a facile manner.

These and other objects of the invention will soon become apparent as we turn now to a description of the drawings and the preferred embodiments.

DESCRIPTION OF THE PREFERRED EMBODIMENT

Figure 1:
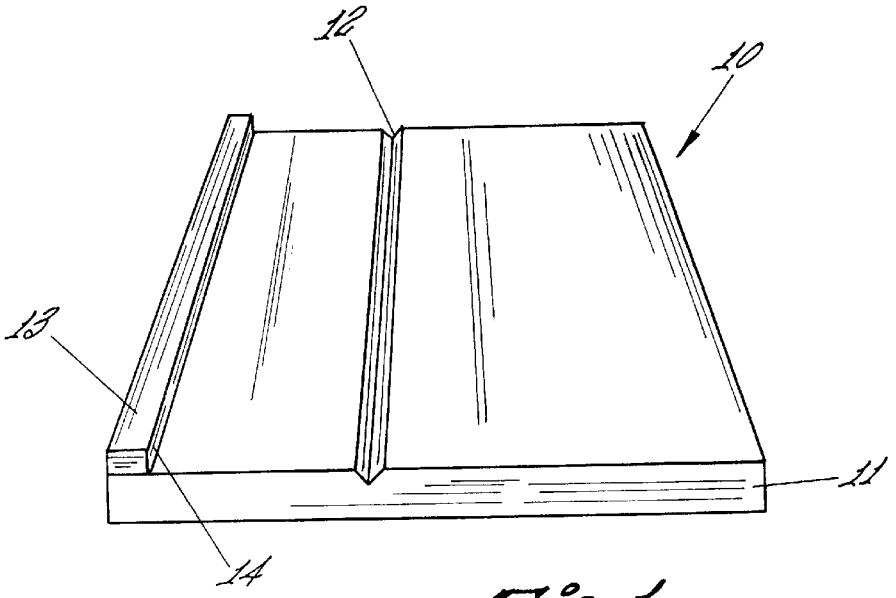
FIG. 1 shows a scoring plate in accordance with the present invention.

A scoring plate generally indicated at the numeral 10 has a flat plate portion 11 and a scoring groove 12 cut therein. A guide rail 13 has a guide rail vertical guide edge 14 which provides a vertical reference line which is parallel to both the scoring groove 12 and one edge of the plate 11.

Figure 2:
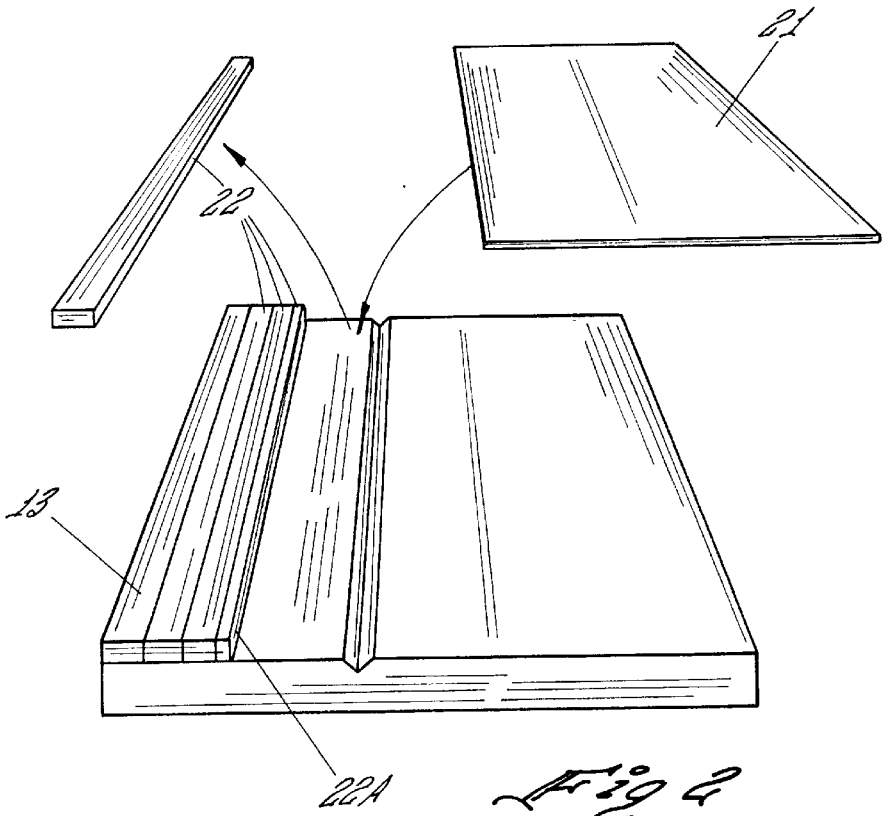
FIG. 2 shows a scoring plate with a plurality of spacers in position to receive a card stock blank.
Figure 3:
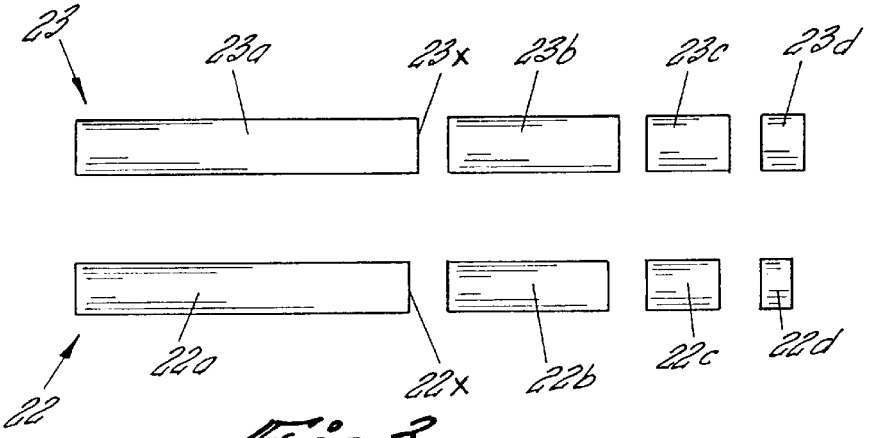
FIG. 3 shows enlarged end view of the two sets of spacers used with the scoring plate.

Turning now to FIGS. 2 and 3 a pair of a series of spacers 22 and 23 are dimensioned to fit between the guide rail 13 and scoring slot 12. The spacers 22 and 23 come in a variety of widths and lengths, i.e. 22*a,* 22*b,* 22*c,* and 22*d,* etc., and 23*a,* 23*b,* 23*c,* and 23*d,* etc., with the spacers 23*a,* 23*b,* 23*c,* and 23*d,* being slightly wider than the corresponding spacers 22*a,* 22*b,* and 22*d.* The purpose for this slight difference in spacing is explained further below. The spacers 22 and 23 each have a vertical edge 22*x* and 23*x* which provide a stop or margin against which one edge of a card stock 21 may be juxtaposed prior to scoring. While the spacers 22 may be any length and width, they are preferably in the range of 0.25" to 2.00" in width and the same length or longer than the scoring groove 12, with the complementary spacers 23 being preferably in the range of 0.30" to 2.05" in width. The variation in distance possible between the scoring groove 12 and the vertical edges 22*x* and 23*x* of the spacers 22 or 23 nearest the scoring groove 12 will depend upon the particular kit, but normally is in the range of 1 inch to 12 inches for home use. It is noted that the depth of the box that is formed using the kit according to the present invention is determined by the distance between the scoring groove 12 and the vertical edges 22*x* and 23*x* of the spacers 22 or 23 nearest to the scoring groove 12. The distance is the maximum depth of the box. Shallower boxes are made by inserting the appropriate spacers 22*a,* 22*b,* 22*c,* and/or 22*d,* etc., and 23*a,* 23*b,* 23*c,* and/or 23*d* between the guide rail 13 and the scoring slot 12.

Figure 4:
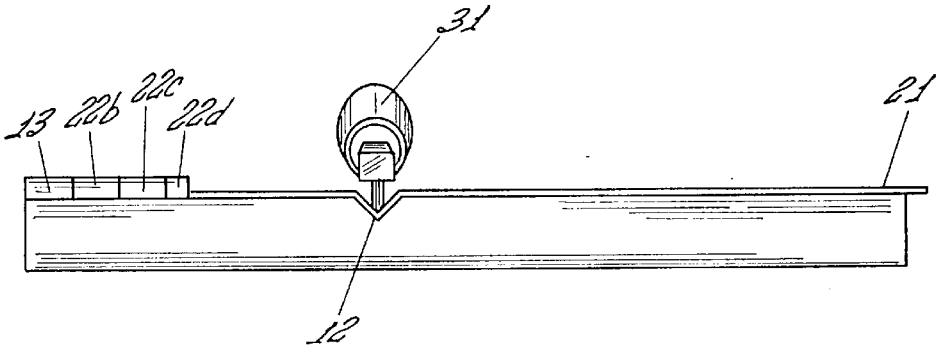
FIG. 4 is an end on view of the scoring plate of FIG. 2 with the spacers placed thereon and a scoring tool employed to score the card stock.

Once the dimensions of the box have been determined, a blank card stock is chosen so that it will have the desired length, width and depth after folding. Card stock may be included as part of the kit or it may be purchased separately. The card stock, once selected, generally indicated at 21, is placed on the scoring plate 11 with one edge against the vertical edge 22*x* of spacer 22*d* nearest the scoring strip 12 as shown in FIG. 4. A scoring tool 31 is pressed against the card stock 21 to force the card stock down into the scoring groove 12 thereby scoring the card stock to generate a folding line. This procedure is repeated for the other three sides of the top or bottom.

Figure 5:
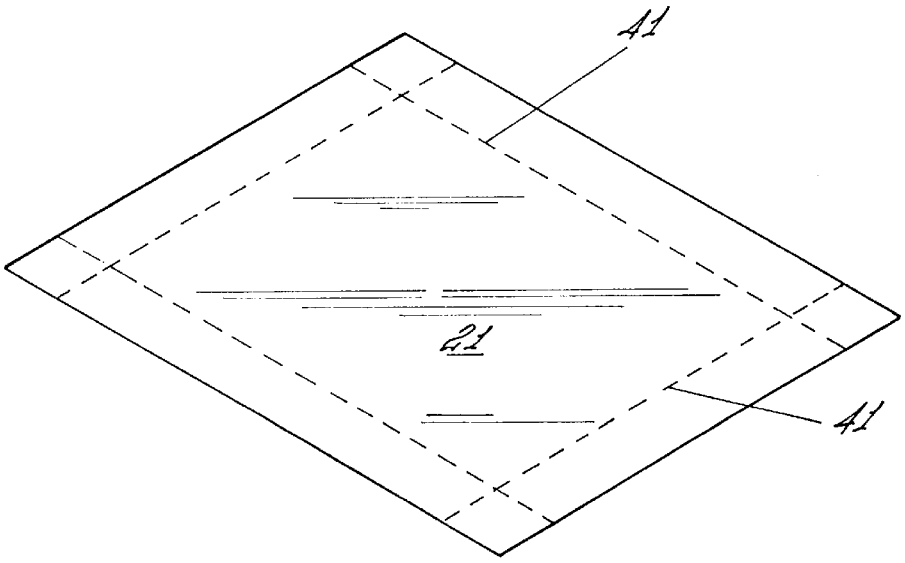
FIG. 5 is a perspective view of a box top or bottom showing the folding lines after it has been scored.
Figure 6:
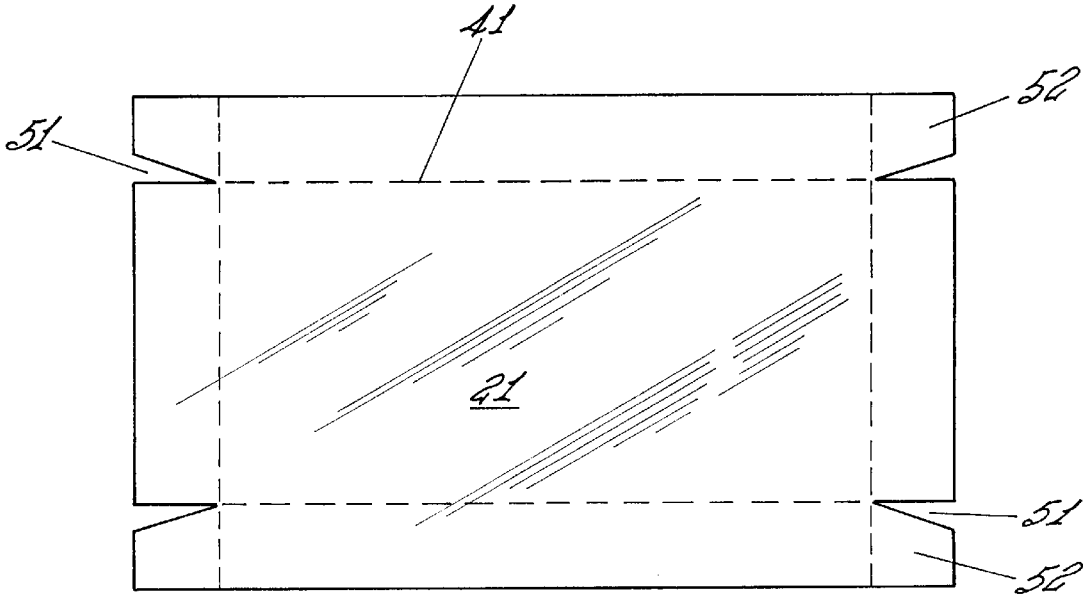
FIG. 6 shows the box top or bottom of FIG. 5 with notches cut in the square corner flaps as shown.
Figure 7:
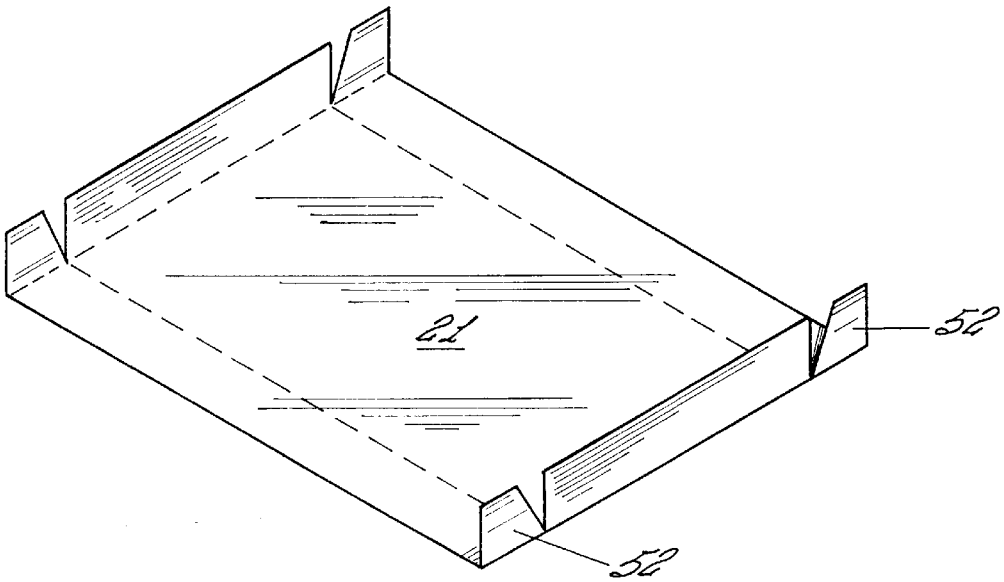
FIG. 7 shows a box top or bottom as shown in FIG. 6 partially folded along the score lines.
Figure 8:
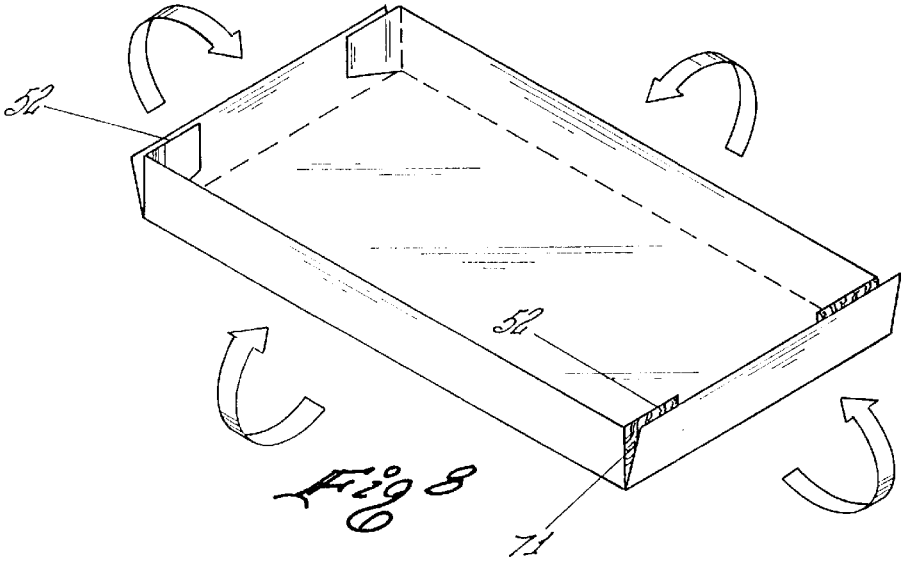
FIG. 8 shows the box top or bottom of FIG. 7 partially folded with adhesive applied to the tabs.
Figure 9:
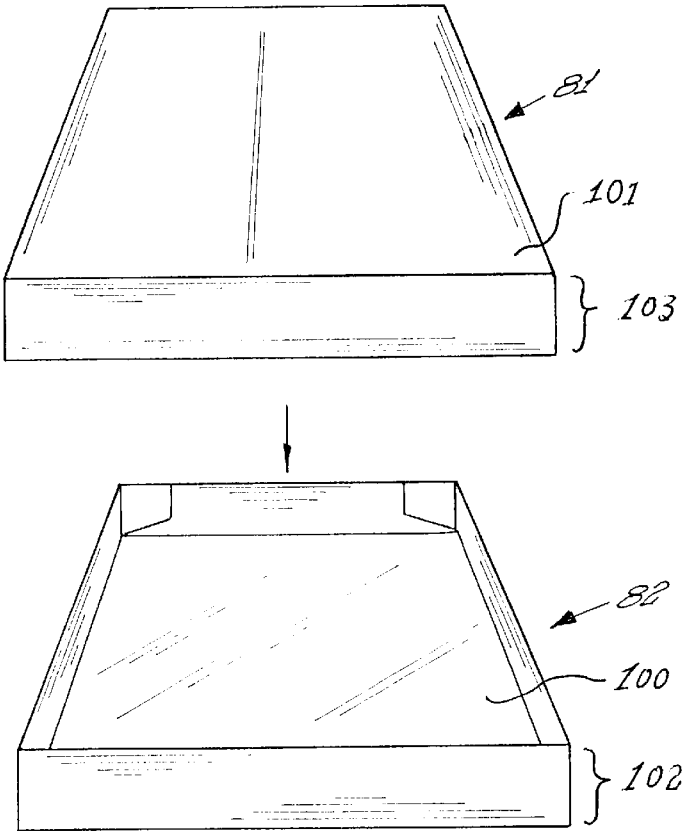
FIG. 9 shows a complete box made in accordance with the kit and method of the present invention.

Turning now to FIG. 5 we see a perspective view of the top or bottom 21 after it has been scored on all four sides clearly showing the folding lines 41. In order to fold the card stock after scoring, notches 51 are cut in the corners of the top or bottom 21 to facilitate closure. The notches 51, which may be conveniently cut with scissors or a sharp blade, may be cut out of either the longest or the shortest edge of the card stock. The box top and bottom fit together best if the notches are cut out of the shortest edge of one and the longest edge of the other. After the notches 51 have been removed from the corners to form tabs 52 as shown in FIG. 6, the top (or bottom) 21 is folded as shown in FIG. 7. Once the folds have been accomplished, an adhesive generally indicated at 71 in FIG. 8 is placed on the tabs 52 after the folds have been made. The sides are then raised in the direction of the broad arrows and held in place by means of the adhesive 71. The procedure is repeated for the top or bottom as appropriate, but with changes in the spacing strips 22 and 23, as described below. The finished top 81 and bottom 82 are shown in FIG. 9. The top 81 may be easily inserted over the bottom as shown. Convenient sizes for card stocks range from 3"×3" to 11"×17". This enables the construction of boxes ranging in size from 1"×1"×1" (the smallest volume) to 15"×9"×1" (the maximum footprint) to 11"×5"×3" (maximum volume). The scoring plate and spacers are preferably made from a durable material that will not undergo delamination such as a hard wood or a plastic. The scoring tool is preferably a bent wire or a rolling wheel with a handle attached thereto. The wheel or bent wire is dimensioned to fit within the scoring groove.

As noted above, both card stock pieces are the same size. Two sets of spacing strips 22*a,* 22*b,* 22*c,* and 22*d,* etc., and 23*a,* 23*b,* 23*c,* and 23*d,* etc. are used. Each spacing strip in set 23 is slightly larger wider than the spacing strips in set 22. The top of the box is made by using the appropriately size strips from the wider set of strips 23 to set the desired depth and footprint of the box top. The bottom of the box is made by replacing one of the wider strips 23*a,* 23*b,* 23*c,* or 23*d,* which was used to make the top of the box, with one of its narrower counterpart spacer 22*a,* 22*b,* 22*c,* or 22*d.* As shown in FIG. 9, this use of a narrower spacing strips 22*a,* 22*b,* 22*c,* or 22*d* makes the footprint 100 of the box bottom 82 slightly smaller than the footprint 101 of box top 81, but the depth 102 of box bottom 82 slightly larger than the depth 103 of box top 81 box top 81 and box bottom 82. The difference in width of each spacing strip in the sets are approximately two to three times the thickness of the card stock. For example, if 0.020" thick card stock is used, the difference in width of each spacing strips should be 0.040" (two times the thickness) to 0.060" (three times the thickness). If a looser fit is desires, the difference can be larger. If spacing strip width difference is 0.050", the length and width of the box bottom will each be approximately 0.100" less than the length and width of the box top and they will have a smooth mating fit. For ease of identification, the two different spacing bar sets can be color or pattern coded for quick identification. While the drawings show a box having a rectangular footprint being formed, the kit can be used to form polygonal boxes from polygonal starting card stock.

Figure 10:
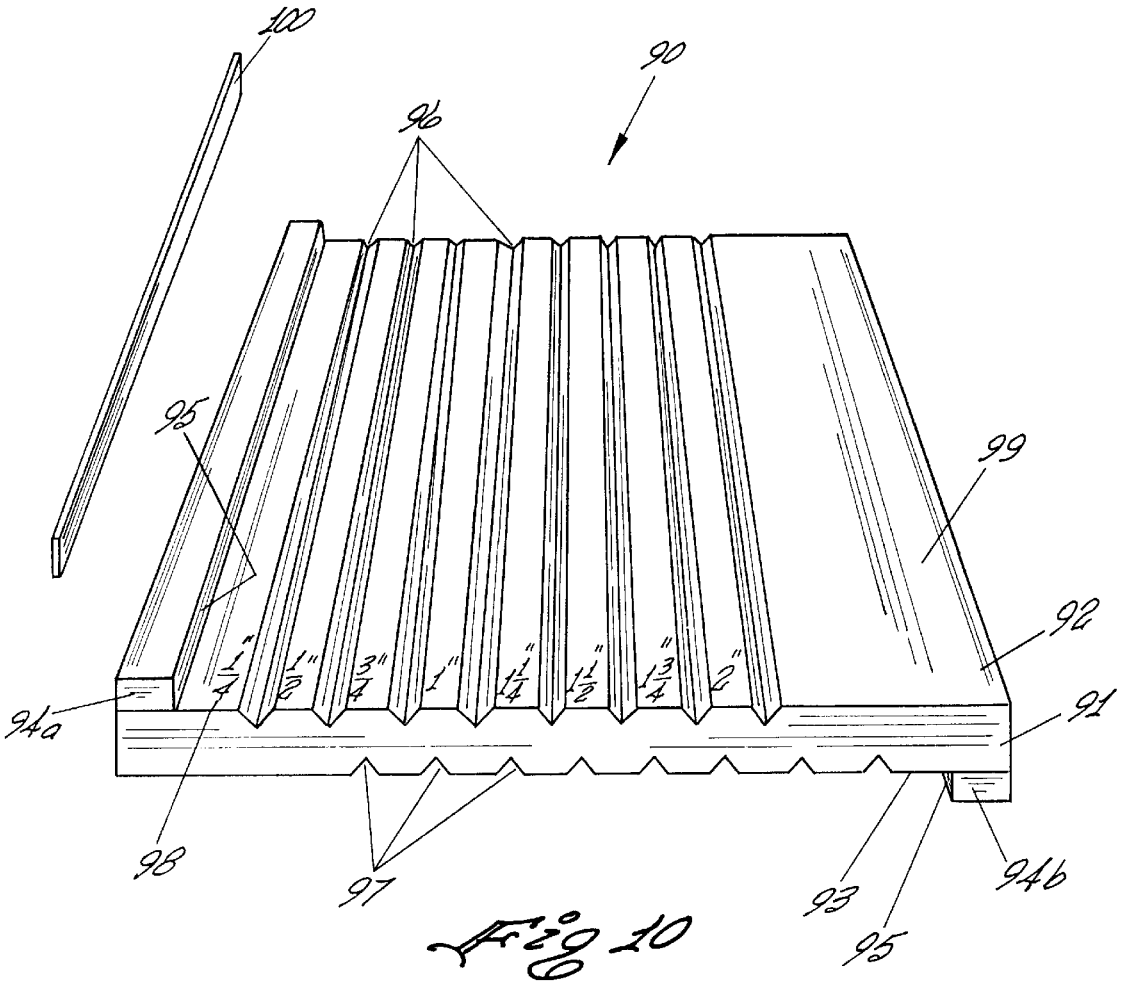
FIG. 10 shows a top perspective view of a second embodiment of the kit of the invention with a scoring plate with guide rails on both sides and with a plurality of parallel scoring lines located thereon.
Figure 11:
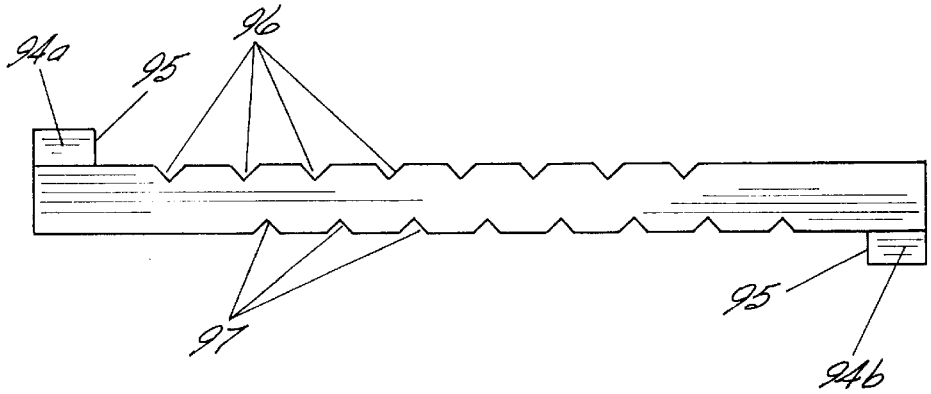
FIG. 11 is an side view of the second embodiment of the kit of the invention.

A second embodiment of the kit of the invention is shown in FIGS. 10 and 11. The second embodiment of the kit 90 comprises a score plate 91 with a top surface 92 and a bottom surface 93. Guide rails 94*a* and 94*b* are placed on one edge each of the top surface 92 and bottom surface 93 of the score plate 91. The guide rails 94*a* and 94*b* have a vertical edge 95 which provides a stop or margin against which one edge of the card stock will be juxtaposed during scoring, much as in the first embodiment of the kit. However, instead of utilizing a series of spacers, a series of parallel grooves 96 and 97 are formed on the top surface 92 and bottom surface 93, respectively, of the score plate 91. These parallel grooves 96 and 97 are parallel to the guide rails 94*a* and 94*b,* respectively, and can be conveniently spaced apart in even increments away from the guide rails 94*a* and 9*b*. To allow card stock of identical dimension to be used to form the top and bottom of a box, the grooves 96 can, for example, be spaced away from the guide rail 94*a* at 0.25", 0.50", 0.75", 1.00", 1.25", 1.50", 1.75" and 2.00", and the grooves 97 can be spaced away from guide rail 94*b* at 0.30", 0.55", 0.80", 1.05", 1.30", 1.55", 1.80" and 2.05". Other spacing increments can be chooses as desired, such as 0.50" increments, or any other increments. This slight difference in separation of the grooves 96 and 97 from the guide rails 94*a* and 94*b* will naturally result in the desired sizes of the box top and bottom, the box top having a larger footprint but lower sides and the box bottom having a smaller footprint but taller sides. Spacing increment markings 98 can preferably be placed on the top surface 92 of the score plate 91, and an indication 99, such as "TOP" that side 92 is used to form the top of the box. The bottom side 93 of the scoring surface 91 can likewise bear size markings and an indication that the bottom surface is used to form the bottom of the box (not shown). A box can be formed using a scoring tool, in the same manner as discussed with respect to the first embodiment of the kit.

In a third embodiment of the invention, instead of providing a scoring plate with a plurality of parallel grooves on both sides, a scoring plate as shown in FIGS. 10 and 11, except without the guide rail 94*b* and grooves 97 on the bottom surface 93 of the score plate 91 can be provided. However, a single narrow spacer 100 having a desired width (e.g. 0.05") to differentiate the top and bottom of the box can be provided, (see FIG. 100) and used by being placing against the vertical edge 95 of guide rail 94*a* when forming the bottom of the box. To form the top of the box with its slightly larger footprint, the spacer 100 will be removed from against the guide rail 94*a*.

While particular embodiments of the present invention have been illustrated and described, it would be obvious to those skilled in the art that various other changes and modifications can be made without departing from the spirit and scope of the invention. For example, boxes may be made in many different shapes besides the rectangular shapes presented herein. They may be triangular or pentagonal or star-shaped. It is therefore intended to cover in the appended claims all such changes and modifications that are within the scope of this invention.

What I claim is:

1. A device for making a box from card stock having a thickness, the box comprising a box bottom having a planar bottom surrounded by respective side walls and a box top having a planar top surrounded by respective side walls, such that the box bottom and box top are sized so that, when assembled, the box top slideably fits together with the box bottom, the device comprising:

(a) a scoring plate having a flat planar top surface dimensioned to accommodate and support a sheet of card stock placed thereon, a top guide rail with a vertical edge affixed therein, and a plurality of top surface parallel and spaced apart elongate scoring grooves formed into the planar top surface, each of the plurality of top surface elongate scoring grooves being parallel to and spaced a uniform distance from the stationary top guide rail vertical edge, wherein the flat planar top is for use in forming the box top, the scoring plate having a flat planar bottom surface, which when inverted, is dimensioned to accommodate and support a sheet of card stock placed thereon, and further comprising a stationary bottom guide rail with a vertical edge affixed thereto, and a plurality of bottom surface parallel and spaced apart elongate scoring grooves formed into the planar bottom surface, each of the plurality of bottom surface parallel and spaced apart elongate scoring grooves being spaced a uniform distance from the stationary bottom guide rail vertical edge, which uniform distance is between two and three times the thickness of the card stock used further away from the bottom guide rail than are the top surface grooves spaced apart from the top guide rail, wherein the flat planar bottom is for use in forming the box bottom; and (b) a scoring tool operable for forcing a portion of a sheet of the card stock into at least one of the top surface scoring grooves, wherein the box top as scored by the flat planar top of the scoring plate will have a slightly larger size and slightly less depth than the box bottom scored by the flat planar bottom of the scoring plate to size the box top and box bottom so that when assembled, the box top slideably fits together with the box bottom.

2. The device of claim 1, further comprising cutting means for use in cutting notches in the planar card stock after scoring.

3. The device of claim 2, further comprising adhesive means for attaching together portions of the scored and cut planar card stock.

4. A device for scoring sheets of planar card stock, having a thickness, in order to form a nestable top and a bottom of a box, whereinafter after being scored, the sheets of the scored card stock can be cut with a cutting means, folded along score lines, and affixed together to form a nestable top and bottom of the box, which nestable top and bottom of the box are sized so that when assembled, the box top and box bottom slideably fit together, the device comprising:

(a) a scoring plate having a flat planar top surface dimensioned to accommodate and support a sheet of card stock placed thereon, a guide rail with a vertical edge affixed thereto, and a plurality of parallel and elongate scoring grooves formed into the planar top surface each scoring groove being parallel to and spaced a uniform distance from the guide rail vertical edge wherein the flat planar top surface is for use in forming the box top, the scoring plate having a flat planar bottom surface, which when inverted, is dimensioned to accommodate and support a sheet of card stock placed thereon, a bottom guide rail with a vertical edge affixed to the bottom surface, and a plurality of parallel and spaced apart bottom surface scoring grooves formed into the planar bottom surface, each scoring groove being parallel to and spaced a uniform distance from the bottom guide rail vertical edge, which uniform distance is slightly greater than the uniform distance the scoring grooves on the top surface are spaced from the top guide rail, wherein the flat planar bottom is for use in forming the box bottom; and (b) a scoring tool operable for forcing a portion of a sheet of card stock into at least one of the scoring grooves to thereby form score lines in the sheet of card stock, wherein the box top as scored by the flat planar top of the scoring plate will have a slightly larger size and slightly less depth than the box bottom scored by the flat planar bottom of the scoring plate to size the box top and box bottom to be nestable, so that when assembled the box top slideably fits together with the box bottom.

* * * * *